US005697126A

United States Patent [19]

Baker, Jr.

[11] Patent Number: 5,697,126

[45] Date of Patent: Dec. 16, 1997

[54] GRID BAR SCRAPER FOR A LINT CLEANER

[75] Inventor: Roy V. Baker, Jr., Lubbock, Tex.

[73] Assignee: The United States of America as represented by the Secretary of Agriculture, Washington, D.C.

[21] Appl. No.: 608,450

[22] Filed: Feb. 28, 1996

[51] Int. Cl.[6] ..... D01B 1/04

[52] U.S. Cl. ..... 19/41; 19/43; 19/50; 19/200; 19/58

[58] Field of Search ..... 19/39, 40, 41, 19/43, 48 R, 50, 51, 58, 59, 62 R, 200, 262, 265

[56] References Cited

U.S. PATENT DOCUMENTS 1,743,069 1/1930 Walsh .
2,174,143 9/1939 Streun .
2,634,461 4/1953 Merkel et al. .
2,658,239 11/1953 Day .
2,679,071 5/1954 Howell .
2,776,455 1/1957 McGregor .
4,996,746 3/1991 Verzilli et al. .

*Primary Examiner*—Michael A. Neas
*Attorney, Agent, or Firm*—M. Howard Silverstein; Randall E. Deck; John D. Fado

[57] ABSTRACT

A device for removing foreign matter that collects on a cleaning bar in an apparatus for cleaning fibers of material. The device includes a scraper slidably mounted on a cleaning bar, such as a grid bar in a lint cleaner for scraping foreign matter and lint off the grid bar when the scraper slides along the length of the grid bar. The scraper includes a scraper bar that is in sliding contact with a top surface of the grid bar. The edges of the scraper may be sharp to improve the scraping efficiency. A scraper back plate extends from the scraper bar. The scraper and back plate are mounted on the grid bar using a guide block so that the scraper is slidable along a length of the grid bar. A guide rail may be mounted first on the grid bar to facilitate mounting of the scraper on the grid bar.

20 Claims, 5 Drawing Sheets

GRID BAR SCRAPER FOR A LINT CLEANER

BACKGROUND OF THE INVENTION

1. Field of the Invention

The present invention relates to a device for cleaning a grid bar for a lint cleaner. More particularly, the invention relates to a scraper slidably mounted on the grid bar for scraping foreign matter from the grid bar.

2. Related Art

A. An Overview of Cotton Ginning

Cotton possesses its highest fiber quality and best potential for spinning when it is on the stalk. Lint quality of the cotton, after it has been picked and baled, however, depends on many factors, including variety, weather conditions, cultural and harvesting practices, moisture and trash content, and ginning processes. The principal function of a cotton gin is to separate lint (fiber) from seed, but the cotton gin must also be equipped to remove from the cotton a large percentage of foreign matter in the baled cotton that would significantly reduce the value of the ginned lint. For purposes of the following discussion, foreign matter is understood to include trash, displaced dry or wet lint, wet matter, debris, fiber, cotton seed, underdeveloped cotton seed, etc. that is associated with the cotton ginning process.

A ginner generally has two objectives: (1) to produce lint of satisfactory quality for the growers' market; and (2) to gin the cotton with minimum reduction in fiber spinning quality so that the cotton would meet the demands of its ultimate users—the spinner and the consumer. Accordingly, quality preservation during ginning requires the proper selection and efficient operation of each machine that is included in a ginning system.

To begin ginning, cotton is transported from a trailer or module into a green-boll trap in the gin where green-bolls, rocks and other heavy foreign matter are removed to prevent damage to the machinery. Then, an automatic feed control provides an even, well-dispersed flow of cotton so that the gin's cleaning and drying system will operate more efficiently. The cotton is then heated in a dryer and cleaned in a series of seed cotton cleaners and extractors. After drying and cleaning, the cotton is distributed to each gin stand by a conveyer.

The cotton enters the gin stand, and the saws in the gin stand grasp the cotton and draw it through widely spaced ribs known as huller ribs. The locks of cotton are drawn through the huller ribs into the lower portion of the seed-roll box. The actual ginning process (separation of the seed and lint) takes place in the roll box of the gin stand.

It is very important for cotton to flow uniformly and to be well dispersed, particularly as it leaves the gin stand. Cotton is conveyed from the gin stand through ducts into a lint cleaner's condenser which separates the fiber from the air and forms the fiber into a continuous batt. The batt should be of uniform thickness and be evenly spread over the entire width of the lint cleaner; otherwise, poor cleaning and excessive fiber loss will result.

While inside the lint cleaner, cotton passes through feed rollers and over a feed plate, which applies the fibers in the batt to the lint cleaner saw. The saw carries the fiber under grid bars. The grid bars, aided by centrifugal force, remove immature seeds and foreign matter from the batt. It is important that the clearance between the saw tips and the grid bars be properly set. The grid bar must be straight with a sharp leading edge, and be kept clean to avoid reducing cleaning efficiency and increasing lint loss. Increasing the lint cleaner's feed rate above the manufacturer's recommended rate will decrease cleaning efficiency and increase loss of good fiber.

After the cotton has passed through the lint cleaner, the cleaned cotton is compressed into bales which must then be covered to protect them from contamination during transportation or storage.

For purposes of background and completeness on cotton ginning and specifically lint cleaners, the reader is referred to the following handbook: Anthony, W. S., et al., *Cotton Ginner's Handbook, Agricultural Handbook* No. 503, USDA: Agricultural Research Service, December 1994. This handbook is incorporated in its entirety herein by reference.

B. Problems Associated with Foreign Matter in the Cotton

Cotton, especially mechanically harvested cotton, contains many green, immature bolls and other foreign matter that cause ginning problems, such as clogging of the saw teeth, failure of the seed roll to turn, and accumulation of sticky material or foreign matter on the cleaning devices, such as, the saws, the moting surfaces of the gin stand, and the grid bars of the lint cleaner.

In the lint cleaner, where the grid bars are used to clean the foreign matter from fiber, the build-up of wet, sticky fiber and trash material on the grid bars, especially at a top surface near the sharp leading edge of the grid bar, compromises the cleaning efficiency of the lint cleaner. Because this build-up of foreign matter on the grid bars interferes with the proper cleaning of the batt of lint, the foreign matter must be removed from the grid bar to achieve efficient cleaning.

Conventionally, the grid bars are cleaned by opening the lint cleaner and using a wooden stick to manually clean the grid bars by rubbing the grid bar with the wooden stick. Use of this wooden stick, however, is inefficient, time consuming and ineffective at thoroughly cleaning the grid bars. In addition, gin equipment is made with safety interlocks that require the lint cleaner to be stopped before opening the lint cleaner. Therefore, the lint cleaner must be entirely stopped and powered down before the lint cleaner can be opened to clean the grid bars using the conventional wooden stick technology.

It is inefficient, however, to shut down the lint cleaner as frequently as needed to clean the grid bars. Typically, a cotton gin has one worker per shift whose sole job is to keep the lint cleaner grid bars clean. In an effort to continue operating the lint cleaner during cleaning of the grid bars, safety devices are disabled so that the machine may be opened and cleaned while the lint cleaner is operating. The technique of using a wooden stick to manually remove the foreign matter from the grid bars is dangerous, as well as labor-intensive.

Similar to lint cleaners, cotton gin stands suffer from build-up of foreign matter and lint on their cleaning devices. In particular, cotton gins are equipped with moting systems that have a moting rail for cleaning the cotton. The moting rails are susceptible to the build-up of foreign matter from green, wet cotton. The moting rails are manually cleaned when the gin stand is stopped and the power is locked out.

As an alterative to manual cleaning, U.S. Pat. No. 2,776,455 to McGregor (hereinafter "the McGregor patent") discloses a self-cleaning moting rail for a cotton gin stand of the type having a gang of spaced apart gin saws. Cotton passes between an outer periphery of the gang of gin saws and the moting rail. However, cotton and foreign matter builds up on a vertical side of the moting rail that faces the gin saws, and, specifically, builds up in the area on the side of the moting rail opposing the space between the gin saws.

To remove this build-up on the moting rail, the McGregor patent utilizes a U-shaped guard made of sheet metal disposed over almost the entire length of the moting rail. Specifically, the guard is of such a length that it terminates in close proximity to the ends of the moting rail. Accordingly, the build-up of foreign matter occurs on the guard instead of the moting rail. The guard has a rod that is attached to a side of the guard to impart a transverse, reciprocating, sliding movement to the guard. During this movement of the guard, any incrustations built up on the guard between the gin saws will be shifted into the path of the gin saws, and will be promptly removed thereby. However, the device in the McGregor patent fails to scrape the foreign matter from the moting rail to ensure adequate cleaning. Moreover, the device in the McGregor patent is large in size because it must be substantially as long as the length of the moting rail, and this concept will not properly function in a lint cleaner because of differences in saw design between gin stands and lint cleaners.

In cotton gin plants, it is critical that the foreign matter be removed from the cleaning bars in the various processing machines to insure efficient cleaning of the cotton. If the foreign matter is allowed to build up until it reaches sufficient proportions to obstruct the various working spaces in the associated parts of the machines, the efficiency and operation of the machines will be detrimentally affected. The build-up of foreign matter in the machines may even present a fire hazard. The existing techniques for removing foreign matter from the cleaning bars in the machines of the cotton gin, especially, the grid bars in the lint cleaner, are slow, time consuming, and inefficient. Thus, there is a need in the art for a device for removing foreign matter from the cleaning bars in cotton gin machines that overcome these deficiencies.

SUMMARY OF THE INVENTION

The present invention provides a device for removing foreign matter from cleaning bars used in various machines in a cotton gin plant. Specifically, the device of the present invention is a scraper slidably mounted on a grid bar in a lint cleaner for scraping foreign matter off the grid bar when the scraper slides along the length of the grid bar.

The scraper includes a scraper bar that is in sliding contact with the grid bar. The edges of the scraper may be sharp to improve the scraping efficiency. A scraper back plate extends substantially perpendicularly from the scraper bar, and has an opening for receiving a connector. A guide block is attached substantially perpendicularly to the scraper back plate by the connector. The scraper and back plate are mounted on the grid bar so that the scraper is slidable along a length of the grid bar. A guide rail may be mounted on the grid bar to facilitate mounting of the scraper and guide block on the grid bar.

An advantage of the invention is that it provides a safe, reliable and effective device for cleaning a grid bar in a lint cleaner.

Another advantage is that the present invention can continuously clean the grid bar.

Another advantage of the invention is that it provides a device that scrapes foreign matter from a grid bar in a lint cleaner.

Another advantage of the invention is that it eliminates worker exposure to high-speed saw cylinders in the lint cleaner.

Another advantage of the invention is that it provides an apparatus that ensures maximum lint cleaning performance.

Other advantages and salient features of the invention will become apparent from the following detailed description, which, taken in conjunction with the annexed drawings, discloses preferred embodiments of the invention.

BRIEF DESCRIPTION OF THE FIGURES

The present invention is described with reference to the accompanying drawings. In the drawings, like reference numerals indicate identical or functionally similar elements.

DETAILED DESCRIPTION OF THE PREFERRED EMBODIMENTS

A. Lint Cleaner Overview

Figure 1:
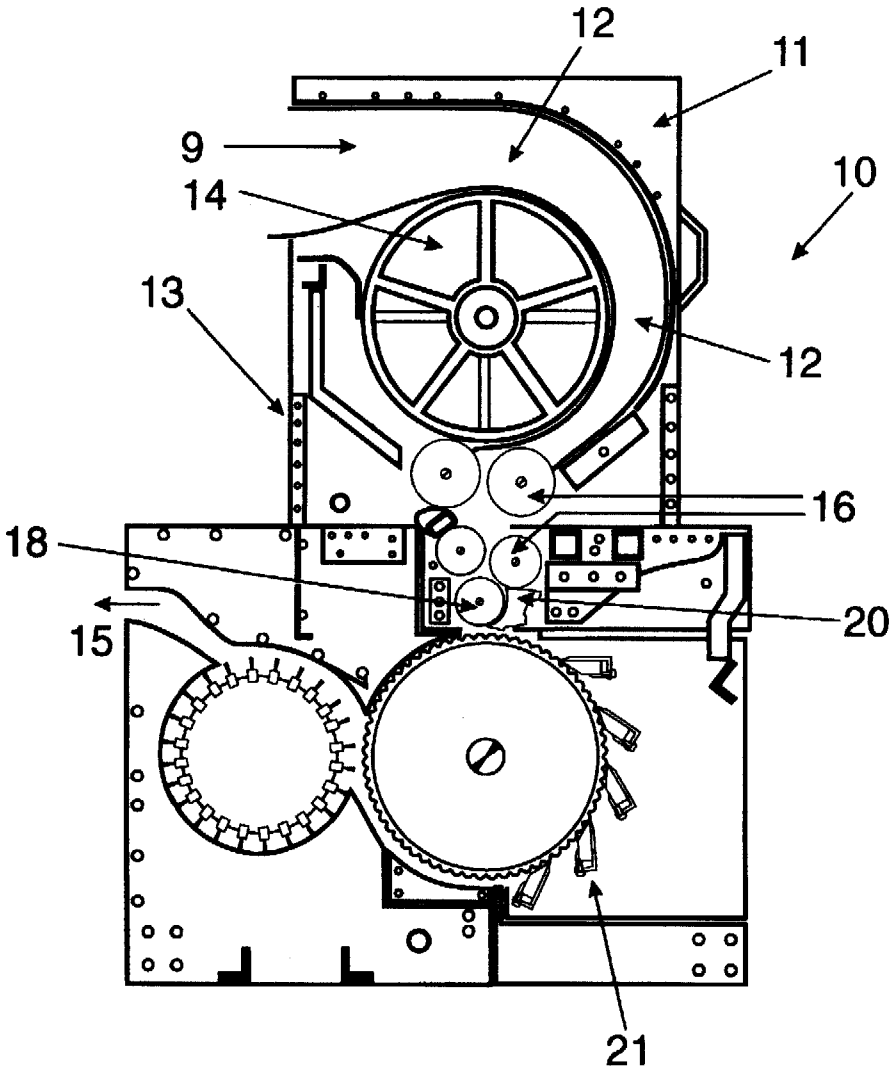
FIG. 1 shows an end view of a unit controlled-batt saw lint cleaner in accordance with the present invention.

For purposes of illustrating the invention, the invention will be discussed for use in a lint cleaner as shown in FIG. 1. Lint cleaners were developed specifically to remove leaf particles, grass, and bark that remain in cotton after seed cotton cleaning, extracting, and ginning. Lint cleaner technology was developed and improved in conjunction with the transition from manual to mechanized harvesting of cotton during the 1950's. With mechanized harvesting, the machine-stripped cotton contains many green immature bolls and foreign matter. Therefore, lint cleaners were developed and improved for improved cleaning of the machine-harvested cotton.

Virtually all gins in the United States have lint-cleaning facilities. Over four-fifths of the gins have two or more stages of lint cleaning (U.S. Bureau of Census, 1979). The lint cleaners now being marketed are of two general types, a flow-through air type and a controlled-batt saw type. For purposes of illustrating the invention, the invention will be described for use in a controlled-batt saw type lint cleaner shown generally at 10 in FIG. 1. Controlled-batt saw lint cleaner 10 is now the most common lint cleaner in the ginning industry.

Controlled-batt saw lint cleaner 10 is housed in a housing 11 that has an inlet 9 and an outlet 15 shown by arrows. Lint from a gin stand or another lint cleaner (neither are shown) enters into housing 11 through inlet 9. The lint is then formed into a batt of fibers 12 on a condenser screen drum 14. Batt 12 is then passed through feed works shown generally at 13. Feed works 13 are shown in more detail in FIG. 2.

Figure 2:
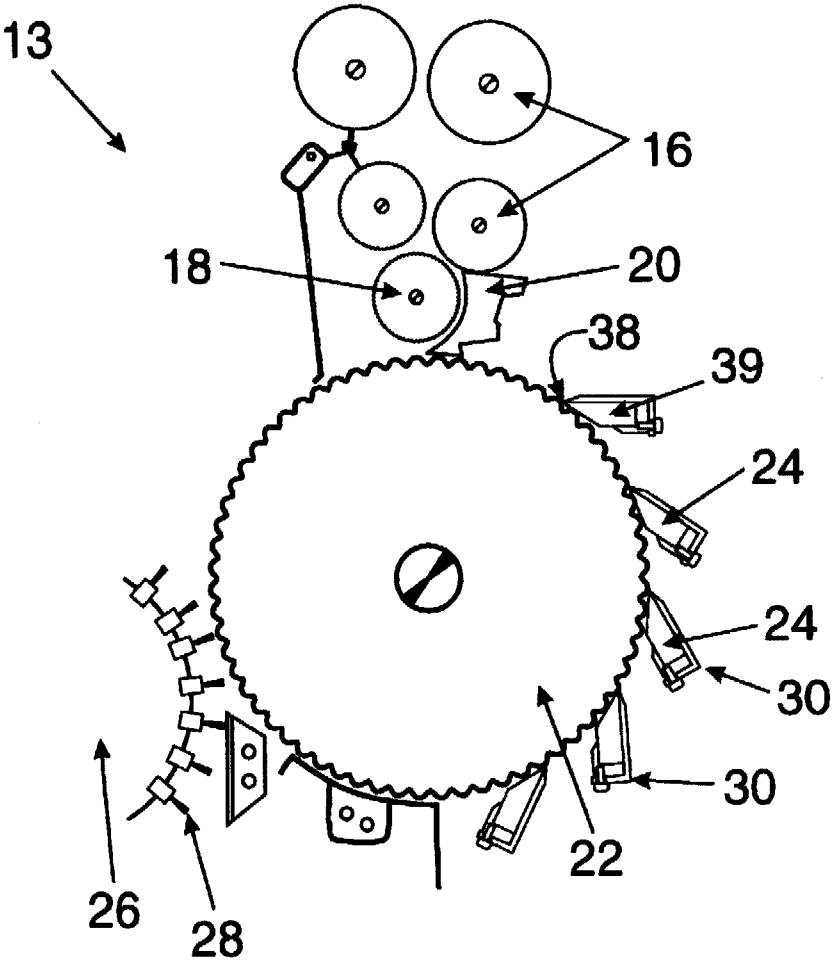
FIG. 2 shows an end view of the feed works of the unit controlled-batt saw lint cleaner shown in FIG. 1.

As best seen in FIG. 2, in feed works 13, batt 12 is: (1) fed through one or more sets of compression rollers 16; (2) passed between a very closely-fitted feed roller 18 and feed plate 20; and (3) fed onto a saw cylinder 22. Each set of compression rollers 16 rotates slightly faster than the preceding set and causes some thinning of batt 12. Feed roller 18 and feed plate 20 grip batt 12 so that combing and opening actions take place as saw teeth on saw cylinder 22 seize the fibers composing batt 12. As a result of this action, the fibers no longer occur in batt form but as small tufts or clusters. Feed plate 20 clears saw cylinder 22 by about one-sixteenth of an inch.

Teeth on saw cylinder 22 transport fibers 12 past a plurality of grid bars 24. The lint fibers 12 cling to the teeth on saw cylinder 22 and are pulled beneath grid bars 24, while the larger particles of trash pass above grid bars 24 to be moved away from fibers 12 and saw cylinder 22, and out of the lint processing stream. Saw cylinder 22 comprises an elongated cylinder that is approximately 12–24 inches in diameter. Grid bars 24 will be discussed in greater detail below.

Fibers 12 are doffed from the saw teeth on saw cylinder 22 by a revolving brush 26 or by air suction (not shown). With brush doffing, a tip speed of a brush tip 28 on revolving brush 26 should be 1.5–2.0 times the tooth tip speed of saw cylinder 22. Revolving brush 26 directs fibers 12 into a conduit for discharging fibers 12 from housing 11 at outlet 15.

B. Compromised Cleaning Efficiency in Lint Cleaners

While fibers 12 are on saw cylinder 22 they are cleaned by a combination of centrifugal force, scrubbing action between saw cylinder 22 and grid bars 24, and gravity assisted by an air current. The foreign matter that is cleaned from fibers 12 passes over grid bars 24 in the manner shown in FIG. 1 and is discharged through a discharged chute (not shown).

However, when cotton is harvested before the plants are completely dead, referred to as "green cotton," or when the fiber gets wet from precipitation while in the fields, the trash/fiber that is removed from fibers 12 during cleaning will stick to grid bars 24. When trash/fiber stick to grid bars 24, controlled-batt saw lint cleaner 10, and more particularly, grid bars 24, lose their cleaning effectiveness. As a result, the flow of clean cotton is reduced and trash is not effectively removed, thereby reducing the quality of the processed cotton. This problem is significant because approximately 10–20% of the cotton harvested annually is the type of cotton that results in trash build-up on grid bars 24.

C. An Embodiment of a Scraper Device of the Present Invention

Figure 3:
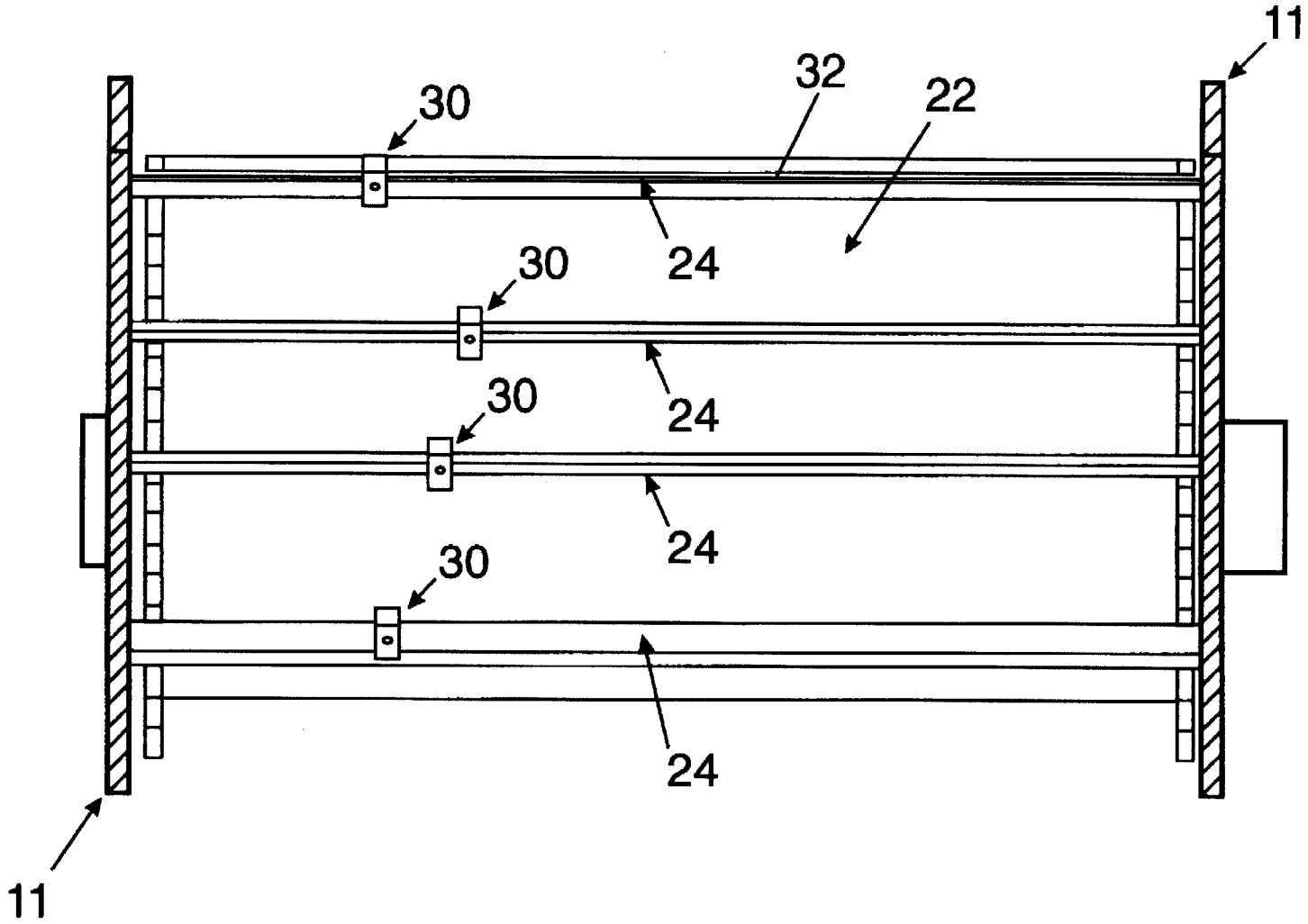
FIG. 3 shows a front view of the saw cylinder and grid bar portion of the unit controlled-batt saw lint cleaner shown in FIG. 1.

The present invention provides a scraper 30 slidably mounted on at least one of grid bars 24 for scraping the foreign matter off grid bars 24. Scraper 30 is shown generally in FIG. 2 mounted on grid bars 24. FIG. 3 shows a front view of a portion of controlled-batt saw lint cleaner 10, including saw cylinder 22 and grid bars 24 having scrapers 30 mounted thereon.

Referring to FIGS. 2 and 3, grid bars 24 comprise elongated bars that extend adjacent to, and in parallel with, saw cylinder 22. Grid bars 24 are attached at either end by end plates 21 (see FIG. 1) to housing 11. Grid bars 24 are approximately 66 inches to 90 inches in length. From an end view, as shown in FIG. 2, grid bars 24 have a generally quadrilateral shape with a sharp leading edge 38 and a trailing end 39. Sharp leading edge 38 is disposed adjacent saw cylinder 22 along its entire length. Sharp leading edge 38 is approximately one thirty-second of an inch from saw cylinder 22. As shown in FIG. 3, scrapers 30 occupy only a small portion of the length of grid bars 24. For example, scrapers 30 may occupy only approximately 2 inches of the length of grid bars 24. Scrapers 30 are slidable along the entire length of grid bars 24.

Figure 4:
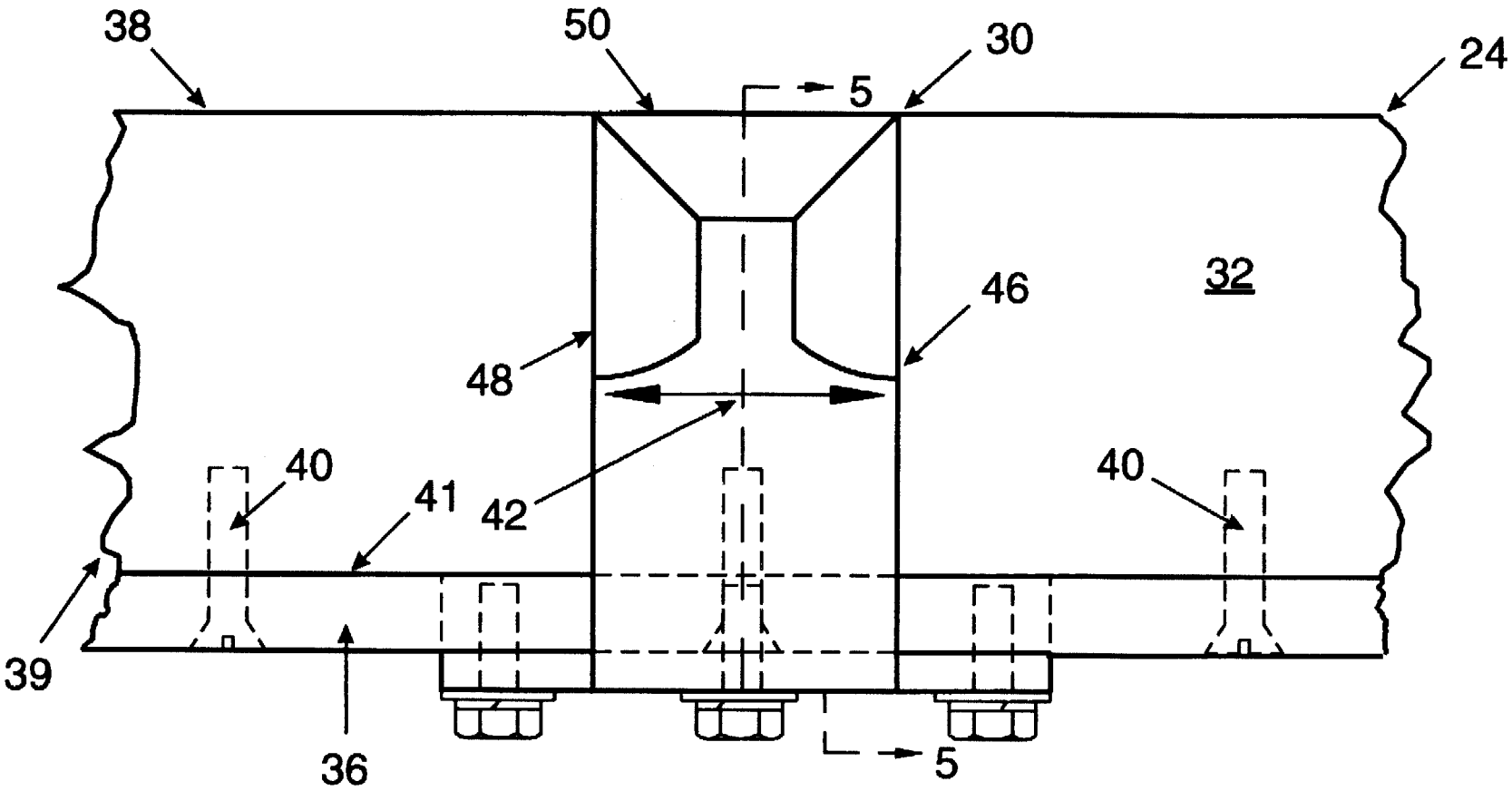
FIG. 4 shows a top view of a grid bar having a scraper in accordance with the present invention mounted thereon.
Figure 5:
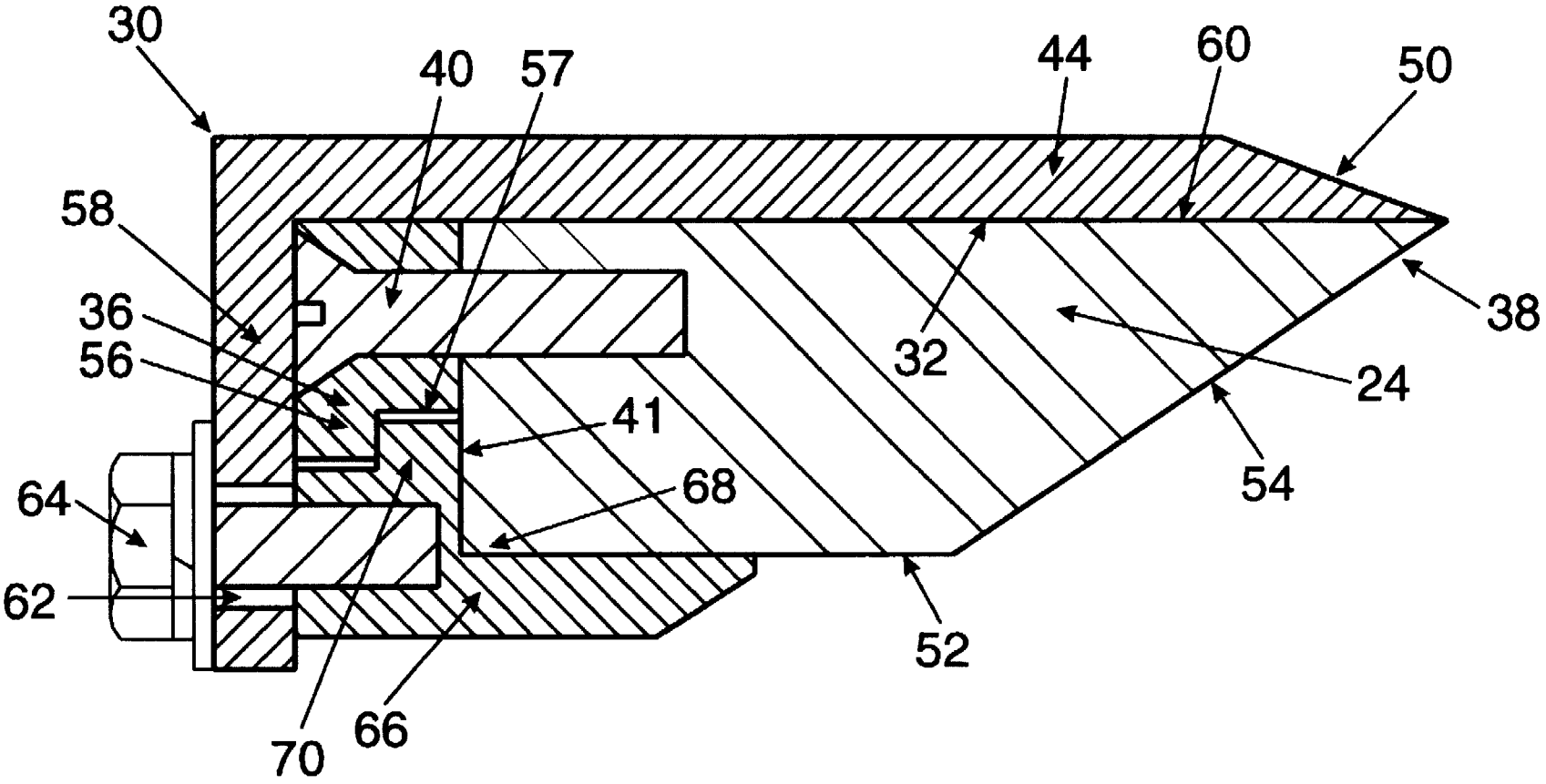
FIG. 5 shows a cross-sectional view taken along line 5—5 shown in FIG. 4.

Referring now to FIGS. 4 and 5, scraper 30 of the present invention will be described in more detail. FIG. 4 shows a top view of a part of one of grid bars 24 having scraper 30 mounted thereon. Scraper 30 is slidably mounted on grid bars 24 so as to scrape the foreign matter that accumulates on a top surface 32 of grid bar 24. To facilitate mounting of scraper 30 on one of grid bars 24, an upper guide rail 36 is attached to a back side 41 of grid bar 24. Upper guide rail 36 is an elongated member that extends along substantially the entire length of grid bar 24, and is attached to grid bar 24 by flathead screws 40 shown in phantom in FIG. 4. The details of how scraper 30 is attached to grid bar 24 via upper guide rail 36, will be discussed below with reference to FIG. 5.

Scraper 30 is mounted on grid bar 24 so as to be slidable back and forth along the entire length of grid bar 24 in the directions shown by bi-directional arrow 42. Scraper 30 has a width at least equal to a width of top surface 32 of grid bar 24 so that the entire width of top surface 32 of grid bar 24 is scraped. Scraper 30 is made to scrape the entire width of grid bar 24 even though the majority of build-up of foreign matter on grid bar 24 occurs in the part of top surface 32 closest to sharp leading edge 38. The length of the scraper (measured along the length of the grid bar 24) is not critical, but should be small enough to allow scraping of substantially the entire length of the grid bar 24. Without being limited thereto, the scraper 30 is generally about 0.5 to 6 inches long, preferably about 2 inches.

To facilitate the scraping action, scraper 30 may have sharp edges 46 and 48 positioned on opposite sides thereof and which are adjacent to the top surface 32 of grid bar 24. Sharp edges 46 and 48 improve the scraping of foreign matter that collects on top surface 32 of grid bar 24. Sharp edges 46 and 48 as shown in FIG. 4, are provided only at a part of scraper 30 that is adjacent sharp leading edge 38 of grid bar 24, because that is where most of the build-up of foreign matter occurs. However, it is within the scope of the invention to have sharp edges 46 and 48 extend for any portion of the width of scraper 30. A front edge 50 of scraper 30 may also be sharpened so that scraper 30 does not interfere with cleaning performed by grid bar 24, particularly, sharp leading edge 38. Edges 46 and 48, and front edge 50 may be formed using conventional techniques such as chiseling, molding or forging.

Referring now to FIG. 5, a cross-sectional view along line 5—5 in FIG. 4 is shown. With reference to FIG. 5, the construction and mounting of scraper 30 on grid bar 24 will be discussed in detail. Grid bar 24 includes: (1) top surface 32 where foreign matter accumulates during the lint cleaning process; (2) back side 41 at trailing end 39 of grid bar 24, which is substantially perpendicular to top surface 32; (3) a lower side 52 which is substantially perpendicular to back side 41 and substantially parallel with top surface 32; and (4) a front side 54 that extends at an angle between lower side 52 and top surface 32 to form a sharp point at sharp leading edge 38 for cleaning foreign matter from batt 12.

Upper guide rail 36, attached to back side 41 of grid bar 24 by flathead screw 40 or other conventional connector, is of a generally rectangular configuration in cross-section. However, upper guide rail 36 is constructed with a channel 57 formed along its lower side, thereby defining a projection 56 projecting downwardly from upper guide rail 36. Channel 57 and projection 56 extend along the entire length of upper guide rail 36. Channel 57 serves as a guide for guiding a lower guide block 66 into position during mounting of scraper 30.

Scraper 30 includes a scraper bar 44 and a scraper back plate 58. Scraper bar 44 has a lower contact surface 60 for being positioned in sliding contact with top surface 32 of grid bar 24. Lower contact surface 60 is substantially planar to correspond to the substantially planar top surface 32 of grid bars 24. Scraper back plate 58 extends substantially perpendicularly from a back end of scraper bar 44. Scraper back plate 58 may be formed integral with scraper bar 44 or may be connected to scraper bar 44 by welding, for example.

In the embodiment shown in FIG. 5, scraper back plate 58 has a slotted opening 62 passing through a distal end of scraper back plate 58. A bolt 64 is passed through slotted opening 62 for bolting scraper 30 to lower guide block 66. By using the slotted opening, size adjustments can be made when mounting scraper 30 to accommodate grid bars 24 that have slightly varying thicknesses.

Scraper 30 is mounted on grid bar 24 via upper guide rail 36 by utilizing lower guide block 66. Lower guide block 66 has an upwardly extending projection 70. Projection 70 extends upwardly from lower guide block 66. Lower guide block 66 is mounted so that projection 70 is slidably disposed in channel 57 of upper guide rail 36. Accordingly, when bolt 64 is tightened, scraper 30 and lower guide block 66 are fastened onto projection 56 of upper guide rail 36 and grid bar 24. The use of projection 56 and projection 70 also serve to keep scraper 30 from sliding off trailing end 39 of grid bar 24. For increased stability, lower grid block 66 may have an optional notched corner 68 for receiving a corner guide bar 24, defined by lower side 52 and back side 41.

Bolt 64 is tightened only to an extent that scraper 30 is slidably attached to grid bar 24. In particular, lower contact surface 60 of scraper bar 44 should be in sliding contact with top surface 32 of grid bar 24 so that the foreign matter is scraped off top surface 32. Scraper 30, in combination with lower guide block 66, frictionally slide along the length of grid bar 24.

The skilled practitioner will recognize that lower guide block 66 may be attached to scraper back plate 58 using a variety of techniques other than bolt 64. Other suitable techniques include clamping or welding, although the latter suffers the disadvantage of not being readily dismantled. Alternatively, guide block 66 may be formed integral with scraper back plate 58. In this embodiment, scraper back plate may be removably connected to scraper bar 44, for example, by bolting or clamping.

Scraper 30, lower guide block 66 and upper guide rail 36 may be formed from conventional metal materials such as steel.

D. Mechanical and/or Electrical Sliding of the Scraper Device

Scraper 30 may be slidably moved along the length of grid bars 24 through the use of mechanical and/or electrical means. For example, an elongated shaft may be attached to bolt 64 or scraper back plate 58 so that an operator uses the shaft to slide scraper 30 along the length of grid bar 24. In the alternative, a mechanically driven chain may be used to slide scraper 30 along the length of grid bar 24. Accordingly, scraper 30 may be automatically drawn back and forth across the length of grid bar 24 for continuous cleaning. As a further alternative, scraper 30 may be slidably moved along the length of grid bar 24 through the use of electrical means, such as conventional electric motors or electronic actuating devices.

E. Alternate Embodiments

The scraper of the present invention may also be used on a moting rail for a saw gin stand. In addition, the scraper of the present invention may be modified to accommodate grid bars having a different shape, such as a round grid bar used in a stick extractor. Moreover, other types of mounting devices for mounting the scraper of the present invention on a grid bar may be used, so long as the scraper remains in sliding contact with the grid bar for removing foreign matter.

F. Conclusion

While various embodiments of the present invention have been described above, it should be understood that they have been presented by way of example only, and not limitation. Thus, the breadth and scope of the present invention should not be limited by any of the above-described exemplary embodiments, but should be defined only in accordance with the following claims and their equivalents.

What is claimed is:

1. An apparatus for cleaning fibers of material, comprising:

a housing;

a transport member disposed in said housing for transporting the fibers of material inside said housing;

a cleaning bar disposed in and supported by said housing, wherein said cleaning bar comprises a first side disposed adjacent said transport member and the fibers of material pass between said transport member and said first side of said cleaning bar, wherein said first side has a sharp edge for removing foreign matter from the fibers of material, and wherein said cleaning bar further comprises a foreign matter collecting surface adjacent to said first side whereby at least a portion of the foreign matter removed by said sharp edge collects on said collecting surface; and a scraper slidably mounted on said collecting surface of said cleaning bar in sliding contact with the portion of said collecting surface which is adjacent to said sharp edge of said first side, wherein said scraper scrapes said cleaning bar by sliding to remove the foreign matter deposited on said collecting surface.

2. An apparatus according to claim 1, wherein said transport member comprises a rotary member with teeth on an outer circumference of said rotary member for engaging the fibers of material to transport the fibers of material past said cleaning bar.

3. An apparatus according to claim 1, wherein said cleaning bar comprises an elongated member having a first end attached to said housing and a second end attached to said housing.

4. An apparatus according to claim 1, wherein said cleaning bar comprises a plurality of grid bars positioned circumferentially around said transport member.

5. An apparatus according to claim 1, wherein said scraper has sharp edges to facilitate removal of the foreign matter from said cleaning bar.

6. An apparatus according to claim 1, wherein said cleaning bar has a length and said scraper is slidable along an entire length of said cleaning bar.

7. An apparatus according to claim 1, further comprising:

a mounting device, wherein said mounting device is for mounting said scraper on said cleaning bar such that said scraper is slidably in contact with said cleaning bar.

8. An apparatus according to claim 1, wherein said cleaning bar has a second side opposing said first side, wherein said apparatus further comprises:

a guide rail attached to said second side of said cleaning bar along an entire length of said cleaning bar, wherein said scraper is mounted on said cleaning bar using said guide rail.

9. An apparatus according to claim 8, wherein said scraper comprises:

a scraper bar, wherein said scraper bar is in sliding contact with said cleaning bar; and a scraper back plate extending substantially perpendicular from said scraper bar.

10. An apparatus according to claim 9, further comprising:

a guide block attached substantially perpendicular to said scraper back plate by an adjustable connector, wherein said scraper and said guide block are slidably mounted on said guide rail and said cleaning bar by adjusting said adjustable connector.

11. An apparatus according to claim 10, wherein said guide block has a channel for receiving a projection projecting from said upper guide rail.

12. An apparatus according to claim 1, wherein said scraper has a length along a length of said cleaning bar and said length of said scraper is a fraction of said length of said cleaning bar.

13. An apparatus according to claim 1 wherein said scraper comprises a substantially planar lower surface which is in sliding contact with said collecting surface of said cleaning bar.

14. An apparatus according to claim 1 wherein said scraper is in sliding contact with the entire width and substantially the entire length of said collecting surface.

15. A device for use in an apparatus for cleaning a batt of material that collects foreign matter on a cleaning bar of the apparatus, comprising:

a scraper bar having a substantially planar sliding contact surface;

a scraper back plate extending substantially perpendicular from said scraper bar; and a guide block attached substantially perpendicular to said scraper back plate, wherein the device is adapted to be slidably mounted on the cleaning bar so that said substantially planar sliding contact surface is in sliding contact with the cleaning bar.

16. A device according to claim 15, further comprising:

a mounting device, wherein said mounting device is for mounting said scraper bar in sliding contact with the cleaning bar.

17. A device according to claim 15, wherein said scraper back plate has a slotted opening for receiving therein a connector for connecting said guide block to said scraper back plate.

18. A device according to claim 15, wherein said scraper bar comprises a sharp edge to facilitate scraping.

19. In a lint cleaner for cleaning fibers of material having a grid bar, the improvement comprising said scraper bar of claim 15 slidably mounted on said grid bar for scraping material therefrom.

20. A lint cleaner according to claim 19 further comprising a guide rail on said grid bar for mounting said guide block of said device on said grid bar.

* * * * *